US005456409A

United States Patent [19]

Roffelsen

[11] Patent Number: 5,456,409

[45] Date of Patent: Oct. 10, 1995

[54] METHOD AND DEVICE FOR MAINTAINING A FLUID AT A WORKING PRESSURE IN A SUBSTANTIALLY CLOSED FLUID CIRCULATION SYSTEM

[75] Inventor: Franciscus Roffelsen, Helmond, Netherlands

[73] Assignee: Spiro Research B.V., Helmond, Netherlands

[21] Appl. No.: 145,494

[22] Filed: Oct. 29, 1993

[30] Foreign Application Priority Data

Oct. 29, 1992 [NL] Netherlands ..... 9201883

[51] Int. Cl.[6] ..... F24D 3/10

[52] U.S. Cl. ..... 237/66; 137/429; 137/493.8

[58] Field of Search ..... 237/66; 137/429, 137/493.8, 493, 593

[56] References Cited

U.S. PATENT DOCUMENTS

| | | | |
|---|---|---|---|
| 3,570,762 | 3/1971 | Wanson | 237/66 |
| 3,834,355 | 9/1974 | Arant | 237/66 X |
| 4,337,873 | 7/1982 | Johnson | 137/493.8 X |
| 4,345,715 | 6/1982 | Van Craenenbroeck | 237/66 |
| 4,456,172 | 6/1984 | Roffelsen | 237/66 |
| 5,007,583 | 4/1991 | Schwarz | 237/66 |

FOREIGN PATENT DOCUMENTS

| | | | |
|---|---|---|---|
| 425777 | 2/1938 | Belgium . | |
| 7102743 | 9/1971 | Netherlands . | |
| 444849 | 3/1936 | United Kingdom | 237/66 |

*Primary Examiner*—William E. Tapolcai

*Attorney, Agent, or Firm*—Varnum, Riddering, Schmidt & Howlett

[57] ABSTRACT

A method and device for maintaining a fluid at a working pressure in a substantially closed fluid circulation system wherein the temperature of the fluid can vary and which is preferably deaerated continuously. The maintenance of a working pressure is realized by keeping the system filled automatically by connecting said system, by means of a closable connection, to a stock of fluid which is under atmospheric pressure, the fluid circulation system and the stock of fluid being connected directly, which connection is opened at and below atmospheric pressure at the location of the connection and, when the working pressure rises, is automatically closed at atmospheric pressure at the location of the connection. If so desired, replenishment of the stock of fluid, which is preferably disposed in the vicinity of the highest point of the system and may serve as expansion possibility for the system, may be effected automatically.

22 Claims, 2 Drawing Sheets

Figure 2:
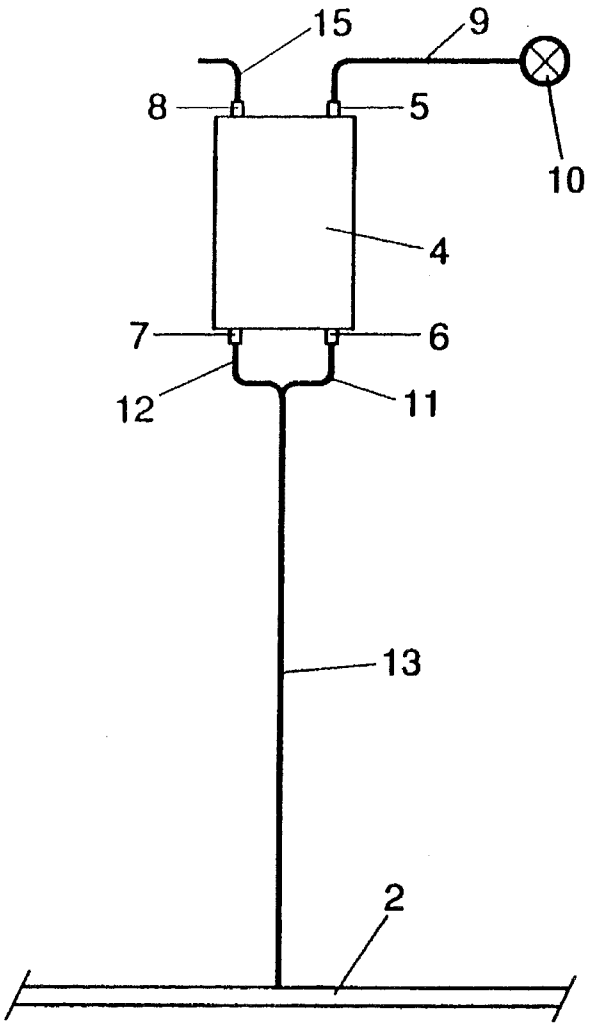

METHOD AND DEVICE FOR MAINTAINING A FLUID AT A WORKING PRESSURE IN A SUBSTANTIALLY CLOSED FLUID CIRCULATION SYSTEM

The invention relates to a method and device for maintaining a fluid at a working pressure in a substantially closed fluid circulation system wherein the temperature of the fluid can vary, the maintenance of a working pressure being realized by keeping the fluid circulation system filled automatically by connecting this system, by means of a closable connection, to a stock of fluid being under atmospheric pressure. The invention also relates to a device for carrying out such a method, to be applied to a storage vessel in such a device, and to a fluid circulation system in which such a method, device and/or storage vessel is used.

A method of the aforementioned type is known from NL-A-7102743 and is intended for use in the central heating technique, wherein water is circulated through a line system and heat is added to the water by a heating boiler, which heat is substantially withdrawn at a number of radiators included in the line system, in particular for the heating of rooms and spaces in a building.

Likewise, it is known that in such installations considerable damage may occur due to corrosion caused by oxygen present in the water. This oxygen may be located in the water with which the installation is filled or may find its way into the substantially closed line system after filling, in particular due to a partial vacuum in the installation during cooling after loss of water through innumerable, microscopically small porous spots in the lines, the capillary action in hemp fibers in sealings, porous spots in welded joints and clamping joints, leakages in sealings at radiator valves, etc. The problem here is that typically such a small amount of water escapes per unit of time, that the leakage water evaporates immediately and thus the leakage spots remain untraceable. Hence, in such an installation an uninterrupted loss of water is a constant factor.

When the loss of pressure in the central heating installation is too great, the central heating installation will fall out of action, i.e., the heating boiler will no longer start, with all unpleasant consequences in cold, wintry periods. The provision that the boiler will not start in the case of a partial vacuum is incorporated intentionally to prevent the possible occurrence of dangerous and detrimental steam formation in the heating boiler in such cases.

In order to compensate losses of water, it has previously been proposed to use an expansion tank included in the line system. However, the compensatory capacity of such an expansion tank becomes exhausted if water is not added periodically. Accordingly, falling out of action of the installation cannot be precluded by building in an expansion tank. The installation falling out of action during cold, wintry periods does not only have unpleasant consequences for the comfort which the installation should provide, but may also have extremely adverse consequences when the water in the closed line system and the equipment included therein freezes, which entails high costs for service and repair.

In the method known from Dutch patent application 7102743, the filling water is drawn in via a non-return valve, opened by a pump driven by the displacement of the membrane in an expansion tank included in the line system. At a relatively low pressure in the line system, fluid is drawn from the stock, which fluid is subsequently forced into the line system by pumping action. Hence, in this manner, a system is provided wherein the fluid is automatically maintained at a working pressure. However, the known system is rather complicated and laborious, requiring the presence of at least an expansion tank and a pump.

The object of the invention is to improve the known fluid circulation system in such a manner that the working pressure of this system can be maintained automatically through relatively simple measures.

According to the invention, this is realized in a method of the type described in the preamble if the fluid circulation system and the stock of fluid are connected directly, which connection is opened at and below atmospheric pressure at the location of the connection and, when the working pressure in the fluid circulation system rises, is automatically closed at atmospheric pressure at the location of the connection.

Through these measures, it is ensured in a particularly simple yet extremely effective manner that the fluid circulation system always remains filled completely with fluid at at least atmospheric pressure. Obviously, the pressure in the system will be lowest when the temperature is lowest, i.e., when heat has been withdrawn but has not been supplied to the system for some time. If in such a situation the pressure at the location of the closable connection becomes equal to the atmospheric pressure, the hitherto closed connection will open and fluid can be added to that in the system, so that no partial vacuum can be formed therein. If the temperature and hence the pressure of the fluid in the system increases again, the connection is closed again automatically and the system can function again in the desired closed and priorly intended manner. In this manner, it is ensured that the system is always filled and maintained at the proper pressure, without requiring the presence of an expansion tank, to be designed in a special manner, and a replenishing pump operated thereby.

The stock of fluid can be chosen to be so large that the system need not be looked after for a long to very long period. Moreover, if so desired, the stock can be replenished at any desired moment, independently of the temperature and pressure in the fluid circulation system. However, in accordance with a further embodiment of the invention, it is preferred that the stock of fluid being under atmospheric pressure is replenished automatically from a further stock of fluid being under excess pressure, if the volume of the first-mentioned stock of fluid falls below a minimum. Through these measures a fully automatic replenishment or refilling of the fluid circulation system is provided.

Hereinabove the use of an expansion tank in known fluid circulation systems has been mentioned. However, utilizing such an expansion tank cannot prevent air being drawn in from outside the line system in the case of the continuous loss of water, also explained hereinabove. As a consequence, the efficiency of the installation is influenced adversely, because air bubbles, hardly capable of transmitting heat, if at all, keep circulating together with the fluid. Such air bubbles may further accumulate in a device which effects the circulation of the fluid, such as a pump, as a consequence of which the transmission action of that device fails partially or even completely with all adverse consequences. Although the possibility exists that in the present method air escapes upon opening of the connection, in particular if, in accordance with a further embodiment of the invention, the stock of fluid under atmospheric pressure is disposed in the vicinity of the highest point of the fluid circulation system, it is further preferred that the circulating fluid in the fluid circulation system is deaerated continuously, for instance in the manner as disclosed in applicant's Dutch patent specification 186 650.

It is not beyond possibility that serious calamities occur, so that the fluid circulation system drains quickly, for instance as a consequence of a line rupture, the failure of a joint or the loosening of a coupling. In such an event, the stock would also drain due to the pressure drop involved, which could increase the adverse consequences of the calamity in question, more particularly in the case where a stock is replenished continuously. In this connection, in accordance with a further embodiment of the invention, it is preferred that at and below atmospheric pressure the opened connection of the stock of fluid with the fluid circulation system is closed automatically if the flow rate in that connection exceeds a predetermined maximum value. Alternatively or additionally, a non-return valve could be arranged in the drain of the further stock of fluid under excess pressure.

In fluid circulation systems of the present type, an overpressure protection will always be present in the form of a relief valve which opens when a pressure in the system is too high. Typically, at the outlet of the relief valve, a receiving device will be arranged to receive and remove the egressive fluid. This conventional provision can be integrated into the present system in an advantageous manner, if, in accordance with a further embodiment of the invention, when the working pressure in the fluid circulation system rises above a predetermined working pressure, the connection between the stock of fluid and the fluid circulation system is opened automatically.

The invention also relates to a device for maintaining a fluid at a working pressure in a substantially closed fluid circulation system provided with means for supplying heat to and withdrawing heat from the fluid circulating through the lines, and with a storage vessel which is in open communication with the atmosphere, further connected by connecting means to the fluid circulation system. Such a system is disclosed in NL-A-7102743. In such an installation the above-described drawbacks occur, which, in accordance with the invention, can be eliminated in that the connecting means comprise a line which connects the storage vessel to the fluid circulation system, in which line closing means are included which are in open position at a pressure below atmospheric pressure in the fluid circulation system and close automatically when the pressure in the fluid circulation system rises and attains atmospheric pressure, while the automatic replenishment of the stock of fluid in the storage vessel can be effected in a simple manner, if the storage vessel is provided with a float, which, when the fluid level falls below a minimum, opens a valve for supplying a fluid from a stock under excess pressure.

In order to minimize the inclusion of air in the stock of fluid as much as possible, in accordance with a further embodiment of the invention, it is preferred that the float substantially covers the free surface of the fluid in the storage vessel. The intended effect can be further promoted if the storage vessel is a substantially closed, hollow body connected to the atmosphere by means of a pipe opening into the storage vessel, which pipe is also capable of removing an excess of fluid in the storage vessel. Through these measures it is further effected that, in spite of its substantially closed shape, the storage vessel cannot be subjected to pressure and an excess of fluid in the storage vessel, if any, can be removed in a controlled manner.

If, due to a calamity, the fluid circulation system drains quickly, particularly a continuously replenished stock of fluid can be held in the storage vessel, if sealing means are included in the connecting means, which sealing means, in the open position of the closing means, seal the connection between the storage vessel and the fluid circulation system when the flow rate of the fluid in the connecting means exceeds a maximum, while the closing means and the sealing means can be combined into a double-action valve in a manner offering additional advantages. In this respect, a single connection to the lines of the fluid circulation system may suffice, if, in accordance with a further embodiment of the invention, the connecting means open into the storage vessel at at least two locations, a first mouth communicating with the closing means and a second mouth with an excess-pressure valve, which, when the pressure in the fluid circulation system rises above a particular value, opens to allow fluid to flow from the fluid circulation system to the storage vessel.

In accordance with a further aspect of the invention, it is preferred that a storage vessel is used consisting of a hollow, substantially closed body provided with

- a first bore for accommodating a supply valve operable by a float accommodated in the hollow body and displaceable therein,
- a second bore for providing a connection with an open entrance to the atmosphere,
- a third bore for accommodating a discharge valve which is to be maintained in the closed position by a pressure applied from outside the storage vessel, and
- a fourth bore for accommodating an excess-pressure valve which is to be opened by a pressure applied from outside the storage vessel, the third and fourth bores being located on the side of the float other than the open entrance of the connection to the atmosphere. In respect of this, for manufacture-technical reasons, it may be preferred that two or more bores are provided in an insert part, mountable in a wall of the storage vessel.

Figure 1:
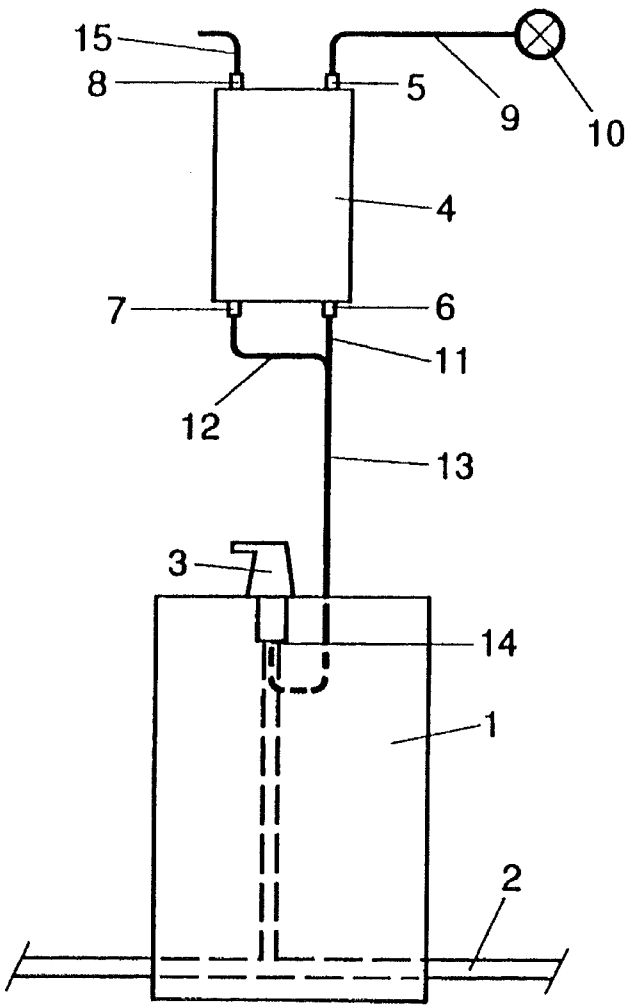
Figure 4:
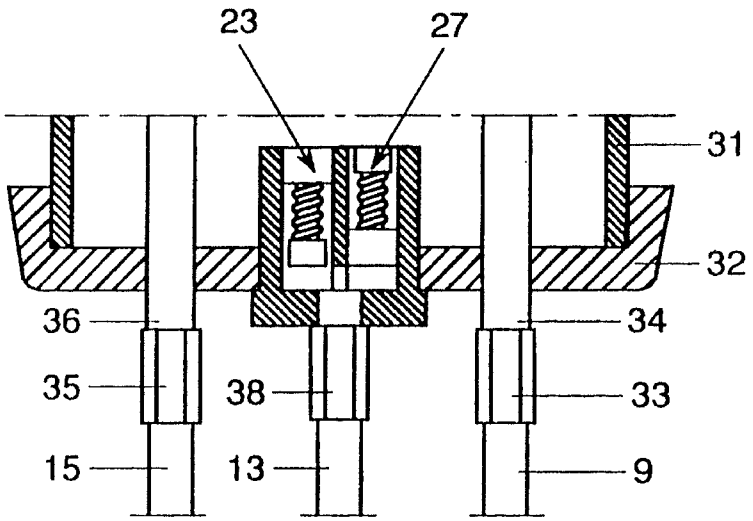
Figure 3:
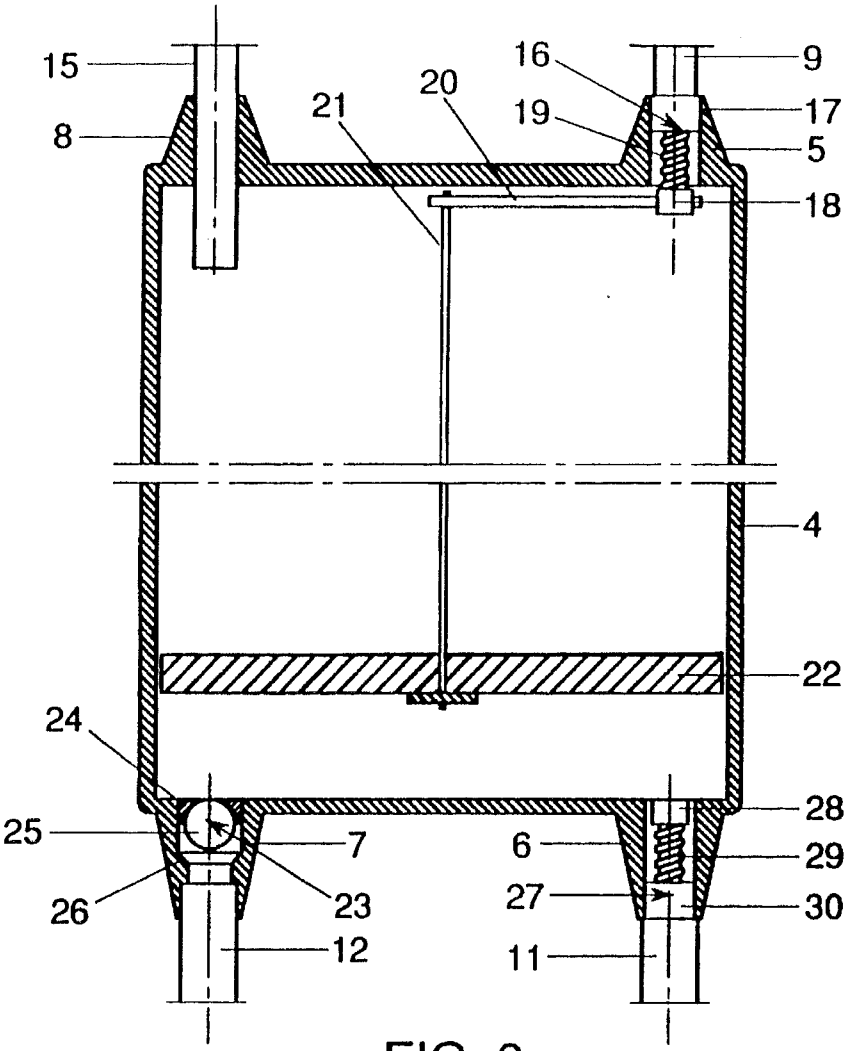

The method and device according to the invention will now be further discussed and explained with reference to the exemplary embodiments shown in the accompanying drawings. In these drawings:

FIG. 1 schematically shows a device according to the invention, disposed in the vicinity of a heating boiler;

FIG. 2 schematically shows a device according to the invention disposed at a distance from a heating boiler;

FIG. 3 shows in cross section a storage vessel to be used in a device according to FIG. 1 or 2; and FIG. 4 shows in cross section a possible variant for the connection of various lines to a storage vessel.

The schematic representation shown in FIG. 1 shows a heating boiler 1, disposed in the vicinity of the highest point of a heating installation and connected thereto by means of a line system 2, provided, at the highest point thereof, with a microbubble vent 3, such as is disclosed in, for instance, Dutch patent specification 186 650.

Further, in the vicinity of the heating boiler 1, there is disposed a storage vessel 4, provided with four stubs 5–8. Connected to the stub 5 is a line 9, connected to the water supply system with the interposition of a tap 10. Connected to the stub 6 is a line 11 and to the stub 7 a line 12. The lines 11 and 12 come together in a line 13, connected to the lower end 14 of the microbubble vent 3. The stub 8 is connected to a vent line 15.

In the case where the heating boiler is not disposed in the vicinity of the highest point of the heating installation, it is preferred that the storage vessel is still disposed in the vicinity of the highest point. This situation is shown in FIG. 2, wherein parts equal to those in FIG. 1 are designated by the same reference numerals and which hence deviates from FIG. 1 to the extent that the line 13 is connected to the line system 2.

FIG. 3 shows a cross section, on an enlarged scale, of the storage vessel 4, used in the system according to FIGS. 1 and 2. Although the body of the storage vessel 4 is represented as a one-piece housing, it is obvious that this housing may also be composed of a number of parts.

Accommodated in the stub 5, to which the line 9 connects, is a valve 16, composed of a part 17, fixed in the stub 5, provided with a central through bore ending at a seat, of a displaceable part 18, provided with a sealing member capable of sealing the through bore in the part 17 when contacted with the seat, and of a helical spring 19, connected to the fixed part 17 as well as to the movable part 19 and which is pretensioned such that the sealing member is drawn towards its closing position against the seat. For opening the valve 16, the movable part 18 should be swivelled relative to the fixed part 17, so that the sealing member will take up a tilted position relative to the seat and the through bore is thus partially cleared. For tilting the movable part 18, a lever arm 20 is attached thereto, to the free end of which a wire or rod 21 is attached, which, in turn, carries a float 22 at the free end thereof, which float covers the free passage of the storage vessel 4 almost completely, but which is displaceable in the housing without friction. In FIG. 3, the float 22 is shown in its normal operation position, the space below the float being filled with fluid. If the fluid level, and hence the float 22, decreases, this results in a swivelling of the lever arm 20 and hence an opening of the valve 16, so that the stock of fluid in the vessel 4 is replenished until the float 22 has reached its level shown in FIG. 3 again and closes the valve 16 automatically. If, by whatever cause, the stock of liquid in the vessel 4 increases and hence the float rises above its normal operating position, this need not influence the operation of the valve 16. In the case where the connection 21 between lever arm 20 and float 22 consists of a wire, the rise of the float will mean that this wire becomes slack and will not influence the closed position of the valve 16. If this connection 22 is a rod, the float should be allowed to move upwards freely along that rod from the normal operating position.

The venting line 15 passes through the stub 8 and has a free mouth within the storage vessel 4. Located in the stub 7, to which the line 12 connects, is a double-action non-return valve 23, provided with a main seat 24 capable of cooperating sealingly with a ball 25, which is relatively light in weight and capable of further cooperating with an auxiliary seat 26, spaced from the main seat 24 and directed oppositely thereto, the ball 25 being capable of cooperating either with the main seat 24 or with the auxiliary seat 26 or with none of the two seats, but in no event with both seats simultaneously. Finally, the stub 6 is provided with a non-return valve 27, provided with a movable part 28, forced by means of a helical spring 29 into the direction of a part 30 fixed in the stub 6, to which part 30 the line 11 connects.

From the above descriptions it will be understood that the valves 16 and 27 only permit flow in the direction of the storage vessel 4, while, in principle, through the valve 23, only flow from the storage vessel is possible, due to the relatively low weight of the ball 25. In the case of a flow through the line 12 in the direction of the storage vessel 4, the ball 25 will contact the main seat 24 almost immediately and block further flow. The ball 25 will block flow from the storage vessel 4 only if the flow-out rate becomes too high. In the case of low flow rate, the ball should, due to its relatively little weight, be subjected to such a rising force, that it will remain clear of the auxiliary seat 26.

The operation of the system schematically shown in FIG. 1 is as follows.

In the starting position, the fluid, in particular water, in the boiler 1 and the line system 2, will be under the desired superatmospheric working pressure, while in the storage vessel 4 the float is in its normal operating position, shown in FIG. 3. During use, the microbubble vent 3 ensures that all gases present in the water are removed.

If during use the working pressure in the heating installation runs too high, this pressure will also prevail in the lines 11–13. The valve 27 is set to the highest working pressure desirable, so that when the working pressure rises above that value, the valve 27 opens and water is pushed into the storage vessel 4, until the pressure in the installation has decreased again to the highest working pressure desirable, after which the valve 27 closes again automatically. Due to the rise of the water level in the storage vessel 4, the float 22 will be moved in upward direction. As mentioned above, this will, however, be without consequences for the valve 16, which will thus remain in the closed position.

During use, water may escape from the installation at innumerable locations, while often the leaks cannot be traced because the escaped water evaporates immediately. If the pressure in such an installation decreases below atmospheric pressure, the installation is automatically put out of operation to prevent steam formation in, in particular, the heating boiler. If in the installation according to FIG. 1 the pressure decreases below atmospheric pressure, the valve 23 opens automatically, so that water flows from the storage vessel 4 via the lines 12 and 13 into the line system 2. Due to this automatic replenishment of the amount of water in the line system 2, the heating installation is prevented from falling out of action. As soon as water runs from the storage vessel 4, the float 22 will come down, swivel the lever arm 20 downwards and open the valve 16, allowing water to flow from the line 9 into the storage vessel 4 until the float is in its normal operating position again and the valve 16 closes automatically.

If the partial vacuum in the heating installation were caused by a serious calamity, for instance line rupture, the storage vessel 4 would drain at high speed and the valve 16 would remain open, which would only aggravate the adverse consequences of the calamity in question. This is now prevented as at higher flow-out rates at the location of the stub 7, the ball 25 is entrained and abuts against the auxiliary seat 26 and thus prevents the storage vessel 4 from draining further.

It is observed that the shape of the float is chosen such that it forms a partition between the air and water present in the storage vessel 4, so that inclusion of air in the water is avoided as much as possible. Further, a spraying effect will occur when the valve 16 is opened, due to the design thereof, so that practically all gases present in the water fed are released and separated.

It is deemed that after the foregoing an explanation of the operation of the system shown schematically in FIG. 2 can be omitted, because all elements relevant to the operation of the system, discussed hereinabove, are also present in the system according to FIG. 2.

FIG. 4 shows in cross section a portion of a modified embodiment of the storage vessel. The vessel comprises a cylindrical part 31, closed at one end thereof by a bottom 32. At the other end of the part 31, a similar lid is present, not shown. The most important difference between this storage vessel and the one shown in FIG. 3 is the fact that all interruptions are provided in the bottom 32. The supply line 9 connects to a line 34 via a coupling 33 and the vent line 15 connects to a line 36 via a coupling 35. The lines 34 and 36 extend through the bottom 32 into the interior of the storage vessel, while the line 36 has a free end, not shown, and the line 34 carries the valve 17 with the lever arm 20, the wire or rod 21 and the float 22. The float 22 is of course provided with interruptions for passing through the lines 34 and 36. The valves 23 and 27 are accommodated in a common housing 37, to which housing the line 13 connects directly via a coupling 38; hence, the lines 11 and 12 have been omitted.

Naturally, many further modifications and variants are possible within the framework of the invention as laid down in the appended claims. Although the exemplary embodiments always provide an automatic replenishment of the stock of water in the vessel, this replenishment can also be effected manually, while this replenishment may be effected at any moment irrespective of the operating situation in the installation. It is further observed that in an installation according to the invention the function of the conventional expansion tank can be taken over by the storage vessel. Should installation instructions require so, the vent line 15 can be connected to a drain to, for instance, a sewer or a similar general provision, to which, in the embodiment according to FIG. 1, the outlet of the microbubble vent 3 can be connected as well.

I claim:

1. A method for maintaining a liquid at a working pressure in a substantially closed liquid circulation system which is completely filled with the liquid and wherein the temperature of the liquid can vary, the maintenance of a working pressure being realized by keeping the liquid circulation system filled automatically by connecting said system, by means of a closable connection, to a stock of liquid being under atmospheric pressure, wherein the liquid circulation system and the stock of liquid are connected directly, which connection is opened at and below atmospheric pressure at the location of the connection and, when the working pressure in the liquid circulation system rises, is automatically closed at atmospheric pressure at the location of the connection.

2. A method according to claim 1, wherein the stock of liquid being under atmospheric pressure is replenished automatically from a further stock of liquid being under excess pressure, if the volume of the first-mentioned stock of liquid falls below a minimum.

3. A method according to claim 1, wherein the circulating liquid in the liquid circulation system is deaerated continuously.

4. A method according to claim 1, wherein at and below atmospheric pressure, the opened connection of the stock of liquid with the liquid circulation system is closed automatically if the flow rate in said connection exceeds a predetermined maximum value.

5. A method according to claim 1, wherein the stock of liquid under atmospheric pressure is disposed in the vicinity of the highest point of the liquid circulation system.

6. A method according to claim 1, wherein when the working pressure in the liquid circulation system rises above a predetermined working pressure, the connection between the stock of liquid and the liquid circulation system is opened automatically.

7. A device for maintaining a liquid at a working pressure in a substantially closed liquid circulation system which is completely filled with the liquid and which is provided with means for supplying heat to and withdrawing heat from the liquid circulating through lines, and with a storage vessel which is in open communication with the atmosphere and connected by connecting means to the liquid circulation system, wherein the connecting means comprise a line which connects the storage vessel to the liquid circulation system, said line including closing means which are in open position at a pressure below atmospheric pressure in the liquid circulation system and close automatically when the pressure in the liquid circulation system rises and attains atmospheric pressure.

8. A device according to claim 7, wherein the storage vessel is provided with a float, which, when the liquid level falls below a minimum, opens a valve for supplying liquid from a stock under excess pressure.

9. A device according to claim 8, wherein the float substantially covers the free surface of the liquid in the storage vessel.

10. A device according to claim 7, wherein the storage vessel is a substantially closed, hollow body connected to the atmosphere by means of a pipe opening into the storage vessel, said pipe also being capable of removing an excess of liquid in the storage vessel.

11. A device according to claim 7, wherein sealing means are included in the connecting means, said sealing means, in the open position of the closing means, sealing the connection between the storage vessel and the fluid circulation system when the flow rate of the fluid in the connecting means exceeds a maximum.

12. A device according to claim 11, wherein the closing means and the sealing means are combined into a double-action valve.

13. A device according to claim 7, wherein the connecting means open into the storage vessel at at least two locations, a first mouth communicating with the closing means and a second mouth with an excess-pressure valve, which, when the pressure in the fluid circulation system rises above a particular value, opens to allow fluid to flow from the fluid circulation system to the storage vessel.

14. A device according to claim 13, wherein the connecting means consist of a line part, of which one end is in open communication with a line of the fluid circulation system and the other end divides into branches, whilst a first branch opening into the storage vessel includes the closing means, and a second branch opening into the storage vessel includes the excess-pressure valve.

15. A storage vessel for use in a device according claim 7, consisting of a hollow, substantially closed body provided with a first bore for accommodating a supply valve operable by a float accommodated in the hollow body and displaceable therein, a second bore for providing a connection with an open entrance to the atmosphere, a third bore for accommodating a discharge valve which is to be maintained in the closed position by a pressure applied from outside the storage vessel, and a fourth bore for accommodating an excess-pressure valve which is to be opened by a pressure applied from outside the storage vessel, the third and fourth bores being located on the side of the float other than the open entrance of the connection to the atmosphere.

16. A storage vessel according to claim 15, wherein two or more bores are provided in an insert part, mountable in a wall of the storage vessel.

17. A liquid circulation system provided with a closed line circuit being completely filled with a liquid and having means for causing the liquid to circulate and for adding heat to and withdrawing heat from the liquid, a device being arranged in the vicinity of the means for adding heat to the liquid, which device continuously withdraws gases entrained by the liquid form the liquid and discharges said gases to the atmosphere, with a device for maintaining a liquid at a working pressure in the circulation system including a storage vessel and a line connecting the storage vessel to the liquid circulation system and a valve in the line, which is in an open position at a pressure below atmospheric pressure in the liquid circulation system and which closes automatically when the pressure in the liquid circulation system rises and attains atmospheric pressure, the liquid circulation system having a highest point and the device for maintaining liquid at a working pressure being disposed in the vicinity of the highest point of the liquid circulation system.

18. A method for maintaining a liquid at a working pressure in a substantially closed liquid circulating heating system filled with the liquid and connected by means of a closable connection to a stock of liquid under atmospheric pressure, the method comprising the steps of:

opening the connection if the pressure in the liquid circulating heating system adjacent the connection falls below atmospheric pressure; and closing the connection if the pressure in the liquid circulation heating system exceeds atmospheric pressure.

19. The method in accordance with claim 18 and further comprising the step of closing the connection if the rate of flow of the liquid through the connection exceeds a predetermined maximum rate.

20. Apparatus for maintaining a liquid in a substantially closed liquid circulating heating system at a working pressure, the apparatus comprising;

a liquid storage vessel storing liquid under atmospheric pressure;

a liquid supply line connected between the liquid circulating heating system and the storage vessel; and a movable valve member in the liquid supply line, the valve member being disposed in an open position when the pressure in the liquid circulation system is below the atmospheric pressure allowing for the flow of liquid into the liquid circulation system;

the valve member having a closing position and automatically moving to the closing position in response to a rise in pressure in the liquid heating circulation system to a level exceeding atmospheric pressure.

21. The apparatus in accordance with claim 21 wherein the valve member having a further closing position and wherein the valve member is forced toward the further closing position to reduce flow of liquid in the liquid supply line when the rate at which liquid flows through the liquid supply line exceeds a maximum rate.

22. The apparatus in accordance with claim 21 wherein the valve member comprises a ball of a preselected weight.

* * * * *